US011213865B2

(12) United States Patent
Kawamori

(10) Patent No.: US 11,213,865 B2
(45) Date of Patent: Jan. 4, 2022

(54) CLEANING METHOD FOR WORKPIECE AND CLEANING APPARATUS

(71) Applicant: SUGINO MACHINE LIMITED, Uozu (JP)

(72) Inventor: Yoshiteru Kawamori, Novi, MI (US)

(73) Assignee: SUGINO MACHINE LIMITED, Uozu (JP)

( * ) Notice: Subject to any disclaimer, the term of this patent is extended or adjusted under 35 U.S.C. 154(b) by 0 days.

(21) Appl. No.: 17/155,656

(22) Filed: Jan. 22, 2021

(65) Prior Publication Data

US 2021/0276051 A1 Sep. 9, 2021

(30) Foreign Application Priority Data

Mar. 9, 2020 (JP) ..... JP2020-039597

(51) Int. Cl.
*B08B 3/02* (2006.01)

(52) U.S. Cl.
CPC ..... *B08B 3/024* (2013.01)

(58) Field of Classification Search
CPC combination set(s) only.
See application file for complete search history.

(56) References Cited

U.S. PATENT DOCUMENTS

| | | | | |
|---|---|---|---|---|
| 2012/0080060 | A1* | 4/2012 | Haremaki | B08B 1/00 134/70 |
| 2017/0043442 | A1* | 2/2017 | Takikawa | B05B 13/0431 |
| 2021/0142458 | A1* | 5/2021 | Miyawaki | B25J 11/0085 |

FOREIGN PATENT DOCUMENTS

| | | | |
|---|---|---|---|
| JP | H5-23914 | A | 2/1993 |
| JP | 2000-126699 | A | 5/2000 |
| JP | 2001-062666 | A | 3/2001 |
| JP | 2015-024454 | A | 2/2015 |
| JP | 2016-159376 | A | 9/2016 |
| JP | 2017-027348 | A | 2/2017 |
| JP | 2017-062657 | A | 3/2017 |
| JP | 6147623 | B2 | 6/2017 |
| WO | 2015/127547 | A1 | 9/2015 |

OTHER PUBLICATIONS

Office Action dated Oct. 6, 2020 in a corresponding Japanese patent application No. 2020-039597.
Extended European Search Report dated Jul. 19, 2021 in a corresponding European patent application No. 21154114.9 (9 pages).

* cited by examiner

*Primary Examiner* — Erin F Bergner
(74) *Attorney, Agent, or Firm* — United IP Counselors, LLC

(57) ABSTRACT

A cleaning method capable of eliminating cleaning unrequired cleaning points is disclosed. The cleaning method is for a workpiece with foreign matter adhered, and the cleaning method includes: identifying cleaning points of the workpiece with the foreign matter adhered; substituting a true value to a cleaning variable for the identified cleaning points; generating a cleaning liquid jet from a main nozzle; skipping a first cleaning section if the cleaning variable has a false value; and executing the first cleaning section to direct the main nozzle toward the cleaning points if the cleaning variable has a true value.

5 Claims, 12 Drawing Sheets

FIG. 4

33h

33d

| LABEL | VARIABLE | | | |
|---|---|---|---|---|
| 1 | #501 | | | |
| 2 | #502 | | | |
| ⋮ | | | | |
| 13 | #551 | #601 | #651 | |
| ⋮ | | | | |

33n

FIG. 5

33g

| | 33h VARIABLE | 33k VALUE | 33p TYPE |
|---|---|---|---|
| 33ha | #500 | 0 | 1 |
| 33hc | #501 | 1 | |
| | #502 | 0 | |
| | ⋮ | ⋮ | |
| 33ha | #600 | 0 | 1 |
| 33hc | #601 | 1 | |
| | #602 | 0 | |
| | #603 | 0 | |
| | ⋮ | ⋮ | |
| 33hb | #650 | 0 | 2 |
| 33hc | #651 | 1 | |
| | ⋮ | ⋮ | |
| 33ha | #700 | 0 | 1 |
| | #701 | 0 | |
| | ⋮ | ⋮ | |
| 33hb | #750 | 0 | 2 |
| | #751 | 0 | |
| | ⋮ | ⋮ | |

33g

| 33h VARIABLE | 33k VALUE |
|---|---|
| #500 | 1 |
| #501 | 1 |
| #502 | 0 |
| ⋮ | |
| #600 | 1 |
| #601 | 1 |
| #602 | 0 |
| #603 | 0 |
| ⋮ | |
| #650 | 1 |
| #651 | 1 |
| ⋮ | |
| #700 | 0 |
| #701 | 0 |
| ⋮ | |
| #750 | 0 |
| #751 | 0 |
| ⋮ | |

CLEANING METHOD FOR WORKPIECE AND CLEANING APPARATUS

CROSS-REFERENCE TO RELATED APPLICATIONS

This application claims the benefit of priority to Japanese Patent Application No. 2020-039597, filed on Mar. 9, 2020, the entire contents of which are hereby incorporated by reference.

BACKGROUND

1. Technical Field

The present invention relates to a cleaning method and a cleaning apparatus.

2. Description of the Background

Provided is a cleaning apparatus including a cleaning chamber, a turret device to which a plurality of nozzles are arranged, and a moving device for driving the turret device (for example, Japanese Patent No. 6147623 (hereinafter referred to as Patent Literature 1)). When cleaning using the cleaning apparatus of Patent Literature 1, cleaning liquid is jetted from the nozzle, and the jet is applied to all the cleaning points of the workpiece in order.

BRIEF SUMMARY

In some cases, the number of cleaning points containing foreign matter may be small. Further, applying the jet to all of the cleaning points requires long cleaning time.

The present invention provides a cleaning method and a cleaning apparatus capable of eliminating the cleaning of unrequired cleaning points.

A first aspect of the present invention is a cleaning method for a workpiece with foreign matter adhered, the cleaning method including:

identifying cleaning points of the workpiece with the foreign matter adhered;

substituting a true value to a cleaning variable for the identified cleaning points;

generating a cleaning liquid jet from a main nozzle;

skipping a first cleaning section if the cleaning variable has a false value; and executing the first cleaning section to direct the main nozzle toward the cleaning points if the cleaning variable has a true value.

A second aspect of the present invention is a cleaning apparatus for cleaning a workpiece having a plurality of cleaning points with foreign matter adhered to at least one of the cleaning points, the cleaning apparatus including:

a main nozzle;

a moving device configured to move the main nozzle relative to the workpiece;

a storage device configured to store a cleaning variable corresponding to the cleaning point, the cleaning variable being binary variable having a true value or a false value, and a numerical control program having a first cleaning section which jumps to a next second cleaning section if the cleaning variable corresponding to the first cleaning section has a false value, the numerical control program configured to execute the first cleaning section otherwise;

an arithmetic device including a variable setting unit configured to set the cleaning variable corresponding to the cleaning point with foreign matter adhered to have a true value, and to set the other cleaning variable to have a false value, and a numerical control unit configured to move the main nozzle relative to the workpiece based on the numerical control program.

The cleaning includes washing and deburring. The particle beam includes an electromagnetic wave and a neutron beam. The electromagnetic wave is, for example, an X-ray or a γ-ray. The object to be removed (hereinafter simply referred to as "foreign matter") is, for example, a chip, a cutting burr, a fiber chip, an abrasive, or a cutting oil. A branch statement is a conditional control statement.

The workpiece is a machine part after machining or before assembly. The workpiece is, for example, a cylinder head, a cylinder block, a crankshaft, a transaxle case, a transaxle housing, a valve body, a pump body or an ABS body. The workpiece includes a structure such as a water hole, an oil hole, a female screw, a through hole, a pin hole, an oil passage, a crank chamber, a cam chamber, a boss, etc. Of these structures, a site to be cleaned with which a jet of cleaning liquid collides is referred to as a cleaning point.

The structure of the foreign matter is defined by a position and a shape of the foreign matter. The structure of a foreign matter may be defined by a substance of the foreign matter.

The cleaning apparatus may include a cleaning device and a scanner. The scanner is, for example, an X-ray CT scanner, a γ-ray CT scanner, or a neutron-ray CT scanner. The scanner is controlled by a control device.

The control device may include a scanning unit and a comparison unit. The scanning unit drives the scanner. The comparison unit compares the scan data of the workpiece obtained by the CT-scan with a 3D model to identify a structure of foreign matter adhered to the workpiece. The comparison unit identifies a cleaning point to which the foreign matter adheres. The comparison unit may specify the cleaning point to which the foreign matter adheres by a label.

The storage device may include a 3D model. The 3D model may include a clean point and a label. A single label corresponds to a single cleaning point.

The cleaning device may include a pump or a tank. The tank stores the cleaning liquid. The pump pressurizes and discharges the cleaning fluid. The pump is, for example, a piston pump, a gear pump, or a volute pump. The discharge pressure of the pump is preferably between 5 and 200 MPa.

The cleaning apparatus may include an automatic nozzle changer or a nozzle selecting device. The nozzle selection device selects, among a plurality of main nozzles, the main nozzle for generating a jet. A plurality of main nozzles may be selected simultaneously. The nozzle selection device is, for example, a turret, or a nozzle switching valve. The nozzle switching valve may be a combination of a plurality of two-way valves. The cleaning device may fix the table (or fix the table to a fixed circular table) and move the nozzle relative to the table. Further, the cleaning device may fix the nozzle (or fix the nozzle to a fixed circular table) and move the workpiece with respect to the nozzle.

The 3D model is a three-dimensional model of a workpiece having a reference magnitude and includes a label affixed to the respective cleaning point. The 3D model may include a plurality of components and may include material information.

The type and data of the cleaning variable, the nozzle variable and the retraction variable may be freely selected.

For example, the variables may be an integer type having a true value of 1 and a false value of 0. The true value may be 0 and the false value may be 1. The true values may be "true" or "A", and the false values may be "false" or "B".

When the first cleaning section is skipped, the process jumps to the closest one of the followings: (1) the next second cleaning section, (2) the next retraction section, (3) the next nozzle selection section, and (4) the footer section.

When skipping the first retraction section, the process jumps to the closest one of the followings: (1) the next retraction section, (2) the next nozzle selection section, and (3) the footer section.

When skipping the first nozzle selection section, the process jumps to the closest one of the followings: (1) the next second nozzle selection section, or (2) the footer section.

Instead of the cleaning variable, a cleaning skip variable may be used. A true value is substituted for the cleaning skip variable associated with a cleaning point to which no foreign matter is adhered. When the cleaning skip variable has a true value, execution of the first cleaning section associated with the cleaning skip variable is skipped. When the cleaning skip variable has a true value, the process may jump to the next second cleaning section. When the cleaning skip variable has a false value, the first cleaning section according to the cleaning skip variable may be executed.

Instead of the retraction variable, a retraction skip variable may be used. A true value is substituted for the retraction skip variable if no foreign matter has adhered to all the cleaning points associated with the retraction variable. If the retraction skip variable has a true value, execution of the first retraction section related to the retraction skip variable is skipped. If the retraction skip variable has a true value, the process may jump to the next second retraction section. If the retraction skip variable has a false value, the first retraction section related to the retraction skip variable may be executed.

Instead of the nozzle variable, a nozzle skip variable may be used. A true value is substituted for the nozzle skip variable if no foreign matter is adhered to all the cleaning points associated with the nozzle skip variable. If the nozzle skip variable has a true value, execution of the first nozzle selection section associated with the nozzle skip variable is skipped. If the nozzle skip variable has a true value, the process may jump to the next second nozzle selection section. If the first nozzle skip variable has a false value, the first nozzle selection section related to the nozzle skip variable may be executed.

The cleaning variable is associated with the retraction variable. The retraction variable is associated with the nozzle variable. The cleaning variable, the retraction variable and the nozzle variable may be associated by the variable name. For example, the variable name is a signed integer.

For example, the variable may have a variable representing its type. Here, the type is any of the cleaning variable, the retraction variable, and the nozzle variable. The cleaning variable is associated with the retraction variable or the nozzle variable that is smaller than the variable name and has the closest variable name.

The variable related to each other may be stored. For example, the associated nozzle variable and the retraction variable may be stored for the cleaning variable.

The comparison unit identifies a cleaning point to which a foreign matter adheres for each workpiece from the scan data. The scan data may include, for example, a casting defect, a machining error, a foreign matter, or a structure of burr. The comparison unit may determine a difference in the structure other than the machining error as a foreign matter. The machining error includes, for example, a position error, a cylindricity, a total runout, and a dimensional error. The burr and the foreign matter appear in the data as a unique protrusion. Further, the foreign matter is sometimes detected as a difference in material. The machining error appears as parallel movement and inclination of the hole or the entire surface, or vibration of the surface. Therefore, the comparison unit performs overall comparison and individual evaluation.

For example, a comparison of a cylindrical hole will be described. The center of gravity of the scan model is compared with the center of gravity of the 3D model for the position of the cylindrical bore. The center of gravity may be identified at a plurality of positions with respect to the depth of the hole. The displacement of the center of gravity position is detected as a position error. In addition, the cylindrical hole of the 3D model is superimposed on the center of gravity of the cylindrical hole of the scan model to obtain the partial difference. When the difference is such that the displacement amount with the 3D model continuously changes and the slope of the displacement amount with respect to the length along the surface of the 3D model of the displacement amount does not exceed the threshold value, the displacement amount is determined as cylindricity.

The comparison unit may identify only the foreign matter whose evaluation value is equal to or larger than the threshold value. The evaluation value is a measurement value of a foreign substance such as a major axis dimension or a volume. The major axis dimension is a dimension where the distance between the two points determined on the surface of the foreign material becomes the longest. The threshold value is an evaluation value of a foreign substance in which no residual is observed after cleaning.

The variable setting unit may set the retraction variable associated with the cleaning variable having a true value to have a true value, and may set the other retraction variables to have a false value. In other words, the variable setting unit may set the retraction variable associated with all the cleaning variables having false values to have a false value.

The variable setting unit may set the nozzle variable associated with the cleaning variable having a true value to have a true value, and may set the other nozzle variables to have a false value. In other words, the variable setting unit may set the nozzle variable associated with all the cleaning variables having false values to have a false value.

All workpieces disposed into the cleaning apparatus may be investigated by the scanner.

The cleaning method and the cleaning apparatus according to the present invention enable to omit the cleaning of unrequired cleaning points.

BRIEF DESCRIPTION OF DRAWINGS

FIG. 4 is a label variable reference table according to the embodiment.

FIG. 5 is a variable table according to the embodiment.

DETAILED DESCRIPTION

Figure 1:
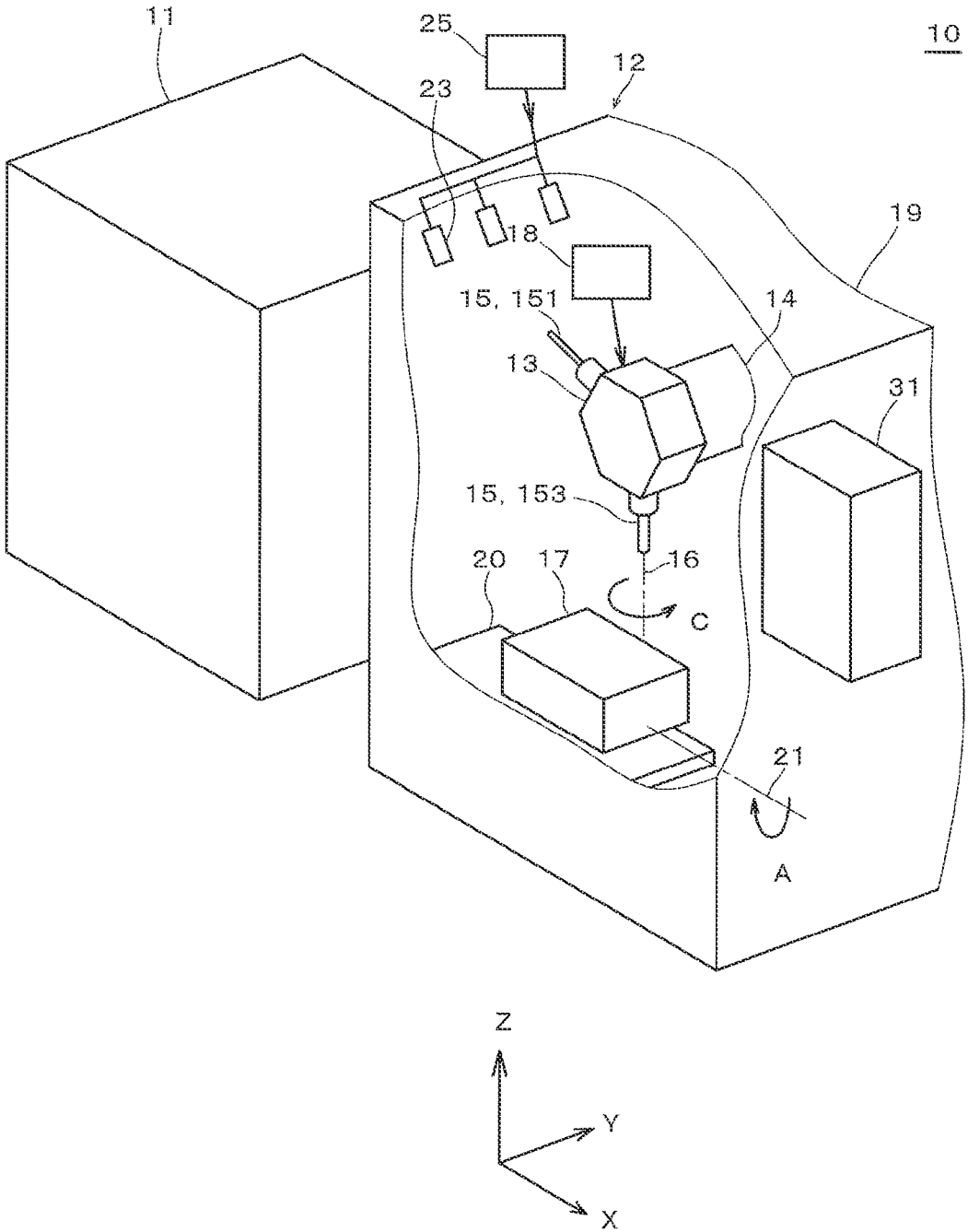
FIG. 1 shows a cleaning apparatus according to the embodiment.

As shown in FIG. 1, the cleaning apparatus 10 according to the embodiment includes an X-ray CT scanner (scanner) 11, a cleaning device 12, and a control device 31. The cleaning device 12 includes a cleaning chamber 19, a pump 18, a moving device 14, a nozzle (main nozzle) 15, and a cleaning table 20. The cleaning device 12 may include a turret (nozzle selecting device) 13, an auxiliary nozzle 23, and an auxiliary pump 25. The nozzle 15 is, for example, a straight jet nozzle 151 or an L-shaped nozzle 153.

The cleaning device 12 cleans or deburrs a workpiece 17 by a jet 47 from the nozzle 15 colliding with the workpiece 17.

The cleaning table 20 is disposed inside the cleaning chamber 19. The cleaning table 20 may be swingable about a rotation axis 21. The rotation axis 21 is parallel to an X-axis direction. The cleaning table 20 positions and fixes the workpiece 17 at a predetermined position.

The pump 18 pressurizes cleaning liquid from a cleaning liquid tank (not shown) and supplies the cleaning liquid to the nozzle 15 via the turret 13.

The moving device 14 freely moves the turret 13 and the nozzle 15 with respect to the cleaning table 20 in a lateral direction (X-axis direction), a front-rear direction (Y-axis direction), and a vertical direction (Z-axis direction).

The turret 13 is disposed on the moving device 14. The turret 13 has a rotation axis 16 parallel to the Z-axis. A plurality of nozzles 15 may be attached to the turret 13. The turret 13 pivots to select one nozzle 15 directing downward. The turret 13 supplies the cleaning liquid to the nozzle 15 which is selected to direct downward.

Preferably, the downwardly selected nozzle 15 can rotate about the rotation axis 16 or can be positioned in a rotational direction.

Figure 7:
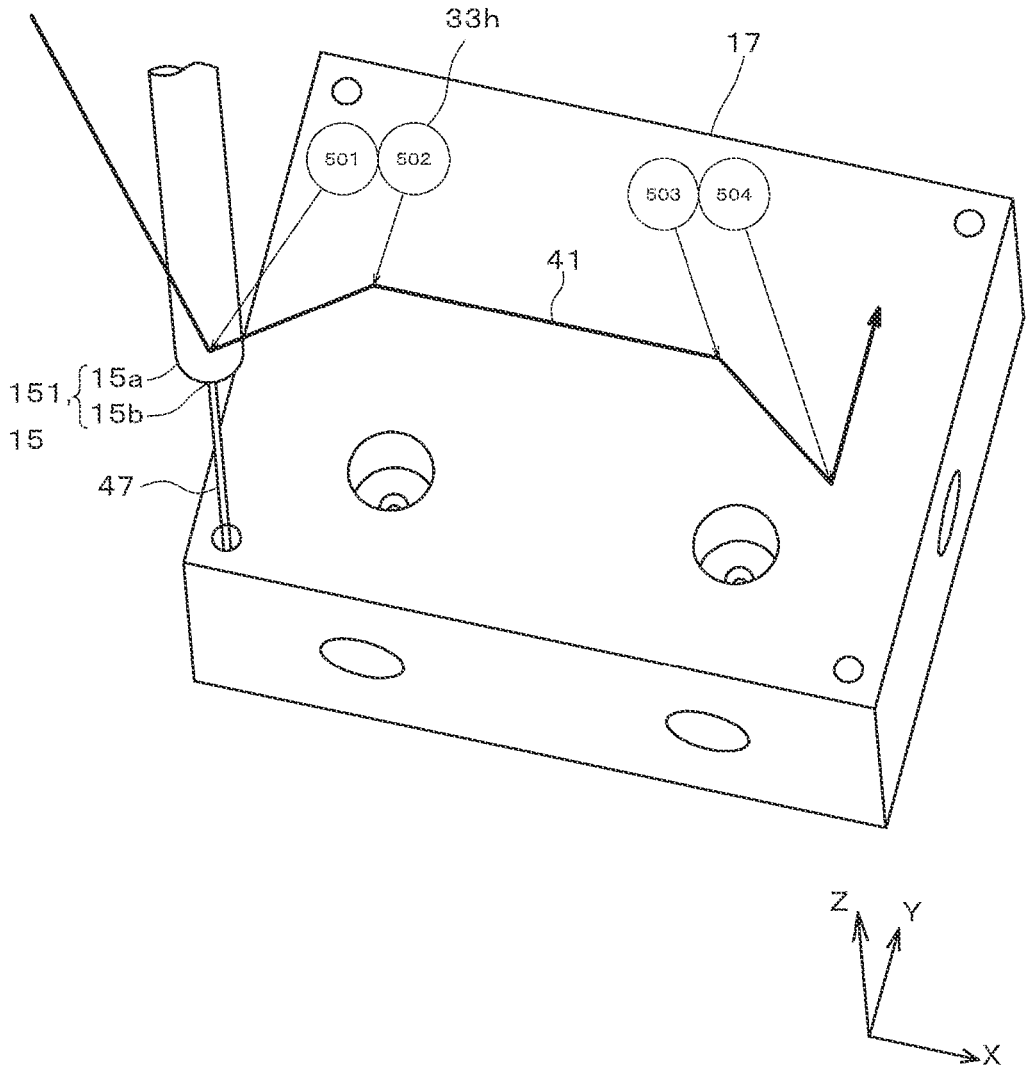
FIG. 7 shows a nozzle path for cleaning all cleaning points according to the embodiment.

As shown in FIG. 7, the straight jet nozzle 151 includes a shaft body 15*a* and an outlet 15*b*. The shaft body 15*a* extends along the rotation axis 16. The outlet 15*b* is located at the distal end of the shaft body 15*a* on the rotation axis 16. The outlet 15*b* generates a jet 47 along the rotation axis 16.

Figure 8:
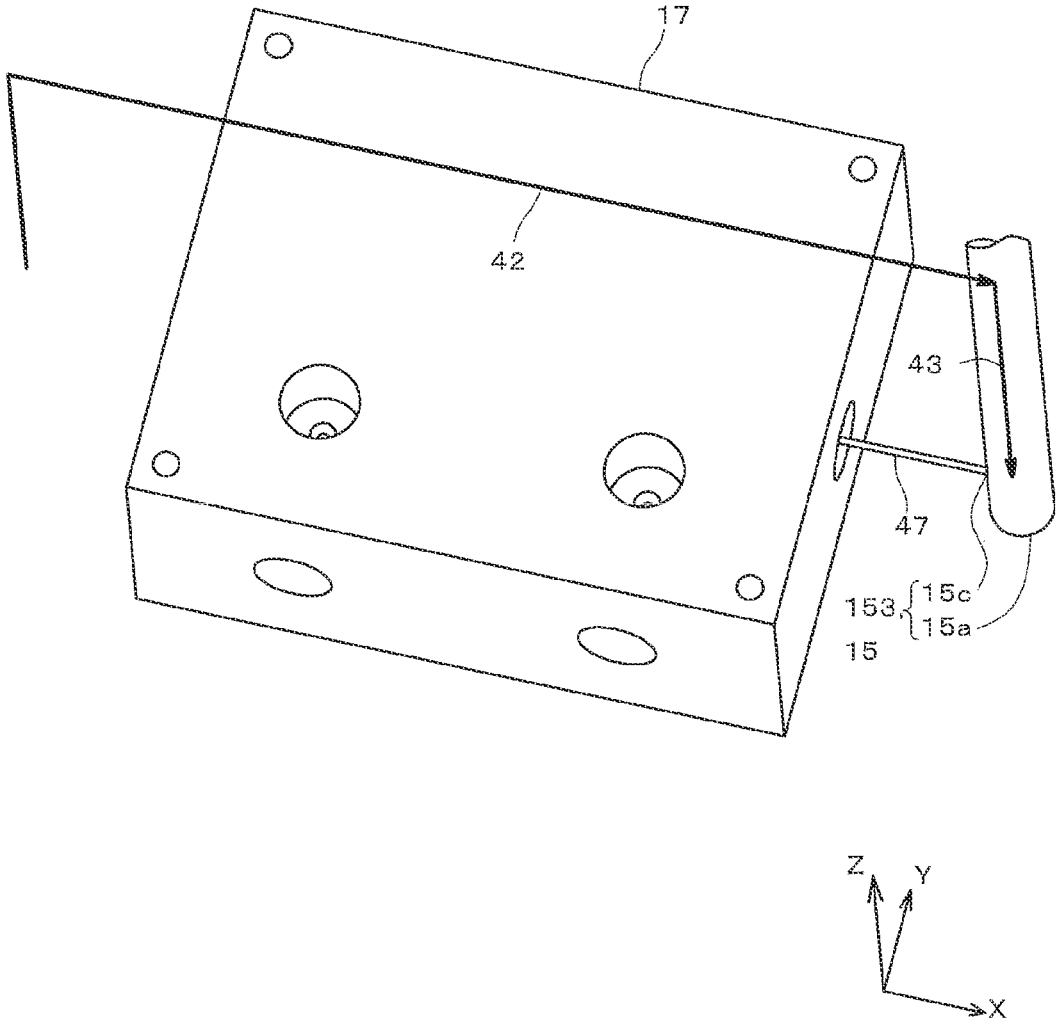
FIG. 8 shows a nozzle path of a retraction portion according to the embodiment.

As shown in FIG. 8, the L-shaped nozzle 153 includes a shaft body 15*a* and an outlet 15*c*. The outlet 15*c* is located at the distal end portion of the shaft body 15*a* to direct perpendicularly to the rotation axis 16. The outlet 15*c* generates the jet 47 in a direction perpendicular to the rotation axis 16.

The auxiliary nozzle 23 is installed on the ceiling surface of the cleaning chamber 19 or the moving device 14 so as to entirely apply the cleaning liquid to the workpiece 17. Preferably, a plurality of auxiliary nozzles 23 are disposed. The auxiliary nozzle is, for example, a fan-shaped jet nozzle, or a conical-shaped jet nozzle. The auxiliary nozzle 23 is connected to the auxiliary pump 25. The auxiliary pump 25 is, for example, a turbine pump. The discharge pressure of the auxiliary pump 25, which is for example 1.5 MPa or less, is lower than the discharge pressure of the pump 18.

Figure 2:
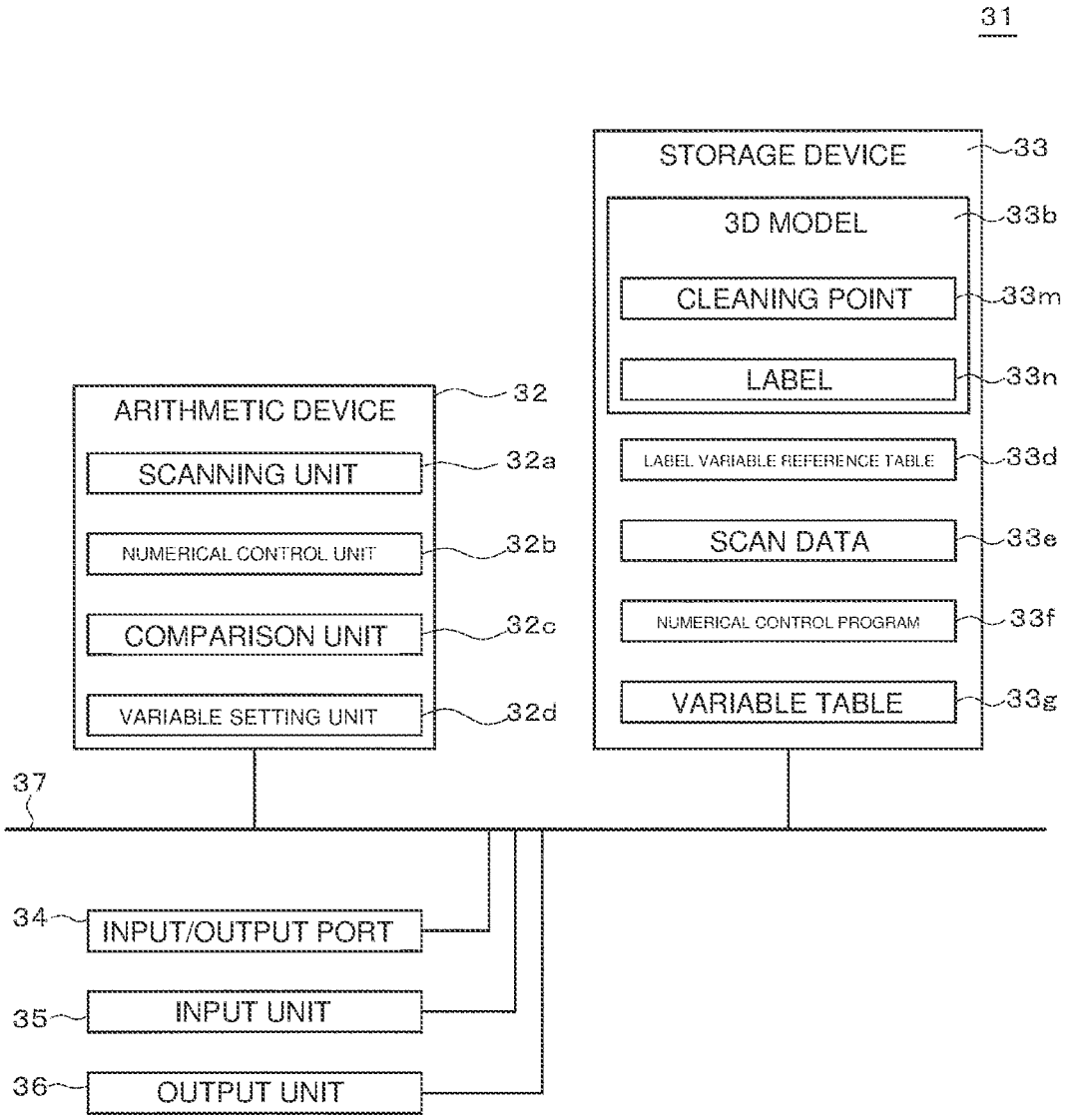
FIG. 2 shows a control device according to the embodiment.

As shown in FIG. 2, the control device 31 includes a storage device 33, an arithmetic device 32, an input/output port 34, an input unit 35, an output unit 36, and a bus 37. The bus 37 communicably connects the arithmetic device 32, the storage device 33, the input/output port 34, the input unit 35, and the output unit 36.

The storage device 33 may include a main storage device or an external storage device. The storage device 33 stores a 3D model 33*b*, a label variable reference table 33*d*, scan data 33*e*, a numerical control program 33*f*, and a variable table 33*g*.

Figure 3:
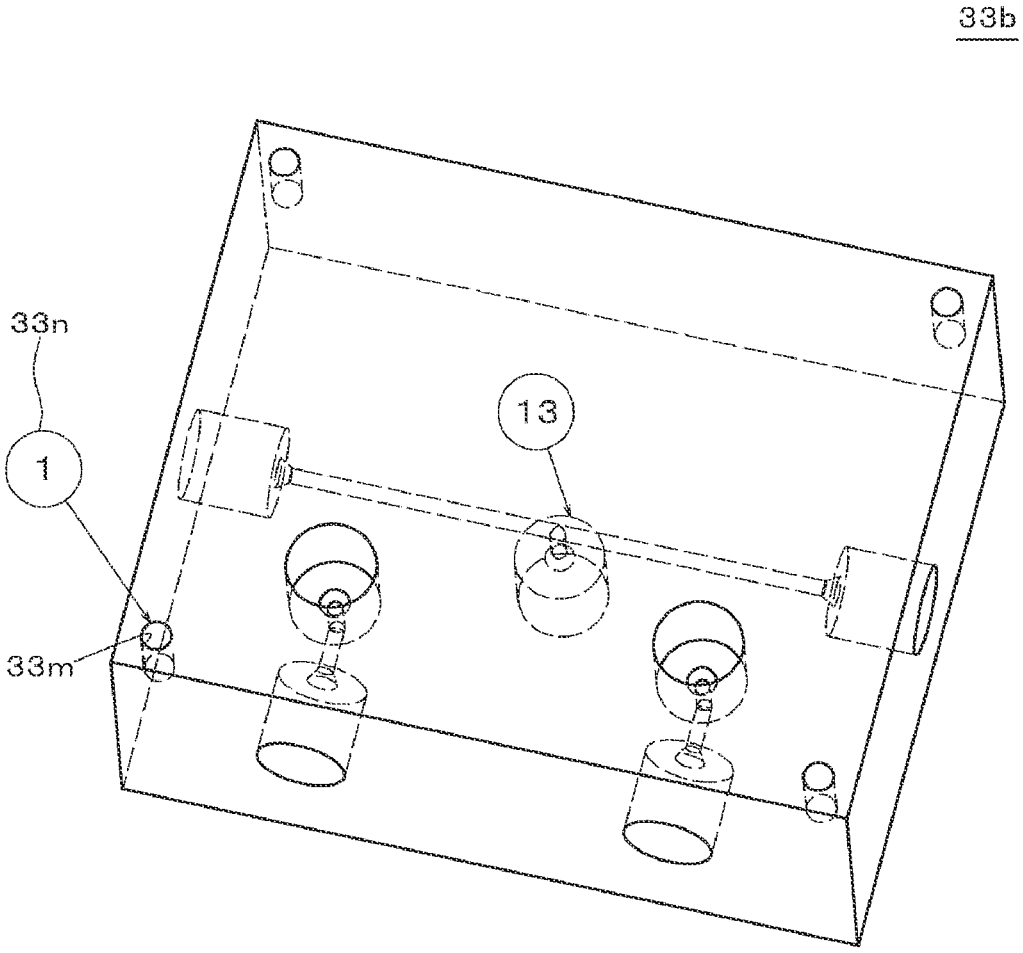
FIG. 3 shows a 3D model according to the embodiment.

As shown in FIG. 3, the 3D model 33*b* includes a plurality of cleaning points 33*m* and labels 33*n*. One label 33*n* is affixed to each of the cleaning points 33*m*.

As shown in FIG. 4, the label variable reference table 33*d* stores at least one variables 33*h* corresponding to each label 33*n*. One or more variables 33*h* always correspond to one label 33*n*. Each variable 33*h* corresponds to a sequence number 33*fa* (described later) having the same number.

The left side of FIG. 5 shows a state in which only the value 33*k* of the cleaning variable 33*hc* is substituted. The right side of FIG. 5 shows a state in which the value 33*k* is substituted for all the variables 33*h*. As shown in FIG. 5, the variable table 33*g* stores a value 33*k* corresponding to the variable 33*h*. The variable 33*h*, which is a binary variable, has a nozzle variable 33*ha*, a retraction variable 33*hb*, and a cleaning variable 33*hc*. The value 33*k* is, for example, either true (cleaning signal) or false (non-cleaning signal). Hereinafter, the true value is set to 1, and the false value is set to 0.

The variable table 33*g* may include a variable 33*p* representing the type of the variable. For example, (1) the variable 33*p* is 0 or null for the cleaning variable; (2) the variable 33*p* is 1 for the nozzle variable; and (3) the variable 33*p* is 2 for the retraction variable. The cleaning variable 33*hc* is associated with the retraction variable 33*hb* of the most recent number which is smaller than the number of the cleaning variable. The cleaning variable 33*hc* is associated with the most recent numbered nozzle variable 33*ha* which is smaller than the number of the cleaning variable.

Figure 6:
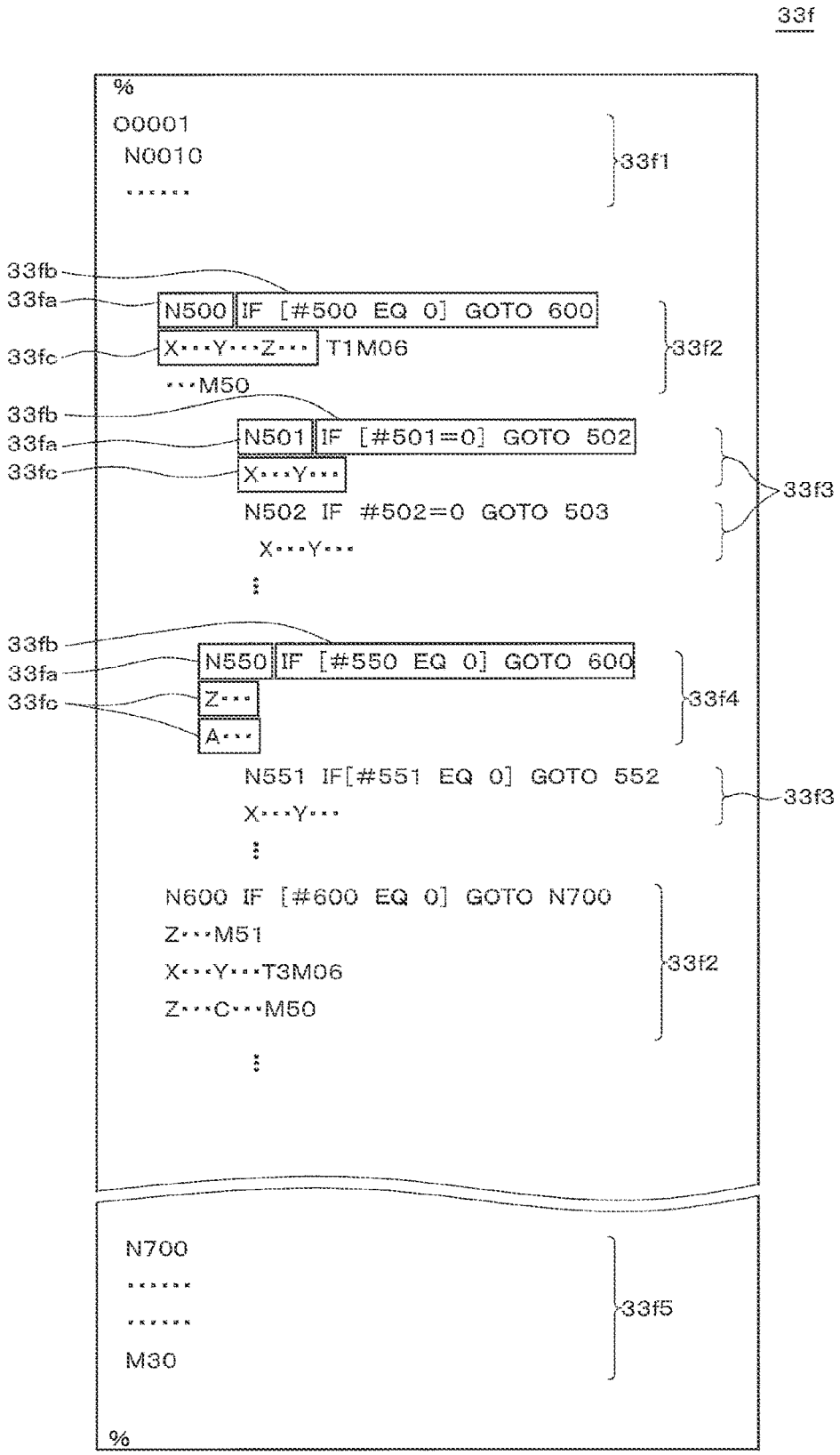
FIG. 6 shows a numerical control program according to the embodiment.

As shown in FIG. 6, the numerical control program 33*f* is, for example, a G code program. The numerical control program 33*f* includes a header section 33*f*1, a nozzle selection section 33*f*2, a cleaning section 33*f*3, a retraction section 33*f*4, and a footer section 33*f*5. The numerical control program 33*f* includes a sequence number 33*fa*, a branch statement 33*fb*, a moving command 33*fc*, G code, an M code, and a T code. The numerical control program 33*f* is read and executed sequentially from the beginning.

The M and T codes are as follows.

M06: Nozzle selection command

M50: Ejection start command

M30: End of block

T1: Straight jet nozzle selection

T3: L-shaped nozzle selection

As shown in FIG. 7, if the numerical control program 33*f* is executed when the values 33*k* of all the variables 33*h* are 1, all the cleaning points 33*m* are cleaned. A trajectory 41 shows a trajectory of the nozzle 151.

As shown in FIG. 6, the sequence number 33*fa* is assigned one by one to the nozzle selection section 33*f*2, the cleaning section 33*f*3 and the retraction section 33*f*4. For example, the sequence number 33*fa* is a value between 500 and 999, including N at the beginning. Desirably, the sequence numbers are assigned in ascending order from the top.

The header section 33f1 includes instructions for a preparation operation such as substitution of a numerical value into a function parameter or a coordinate system, initial setting of the G code, closing a door, clamping, and operation of a pump.

The nozzle selection section 33f2 includes the branch statement 33fb, the moving command 33fc, a nozzle selection command, an ejection start command, and the T code. The branch statement 33fb determines whether or not to execute the nozzle selection. The moving command 33fc relates to the retraction operation. When the nozzle variable 33ha corresponding to the first nozzle selection section 33f2 is 0, the branch statement 33fb included in the first nozzle selection section 33f2 jumps to the closest one of the followings: (1) the next second nozzle selection section 33f2, or (2) the footer section 33f5. Otherwise, the first nozzle selection section 33f2 is executed.

In the numerical control program 33f, the branch statement is represented as follows.

IF [Condition] GOTO (Sequence Number)

If the condition is satisfied, the process jumps to the indicated sequence number. Here, the number with # represents the value 33k of the variable 33h. EQ represents the equal sign (=). The sequence number represents the number without N. For example,

IF [#500 EQ 0] GOTO 600 represents "jumping to the sequence number N600 when the value of variable #500 is 0". When the jump is not made, the numerical control unit 32b reads the next line.

The cleaning section 33f3 includes the sequence number 33fa, the branch statement 33fb, and one or more moving commands 33fc. The branch statement 33fb determines whether or not to clean the corresponding cleaning point. The cleaning section 33f3 indicates a path of the nozzle to each cleaning point.

When the value 33k of the cleaning variable 33hc corresponding to the first cleaning section 33f3 is 0, the branch statement 33fb included in the first cleaning section 33f3 jumps to one of the closest ones of the followings: (1) the next second cleaning section 33f3, (2) the next retraction section 33f4, (3) the next nozzle selecting section 33f2, and (4) the footer section 33f5. Otherwise, the first cleaning section 33f3 is executed.

The retraction section 33f4 includes the sequence number 33fa, the branch statement 33fb, and one or more moving commands 33fc. The branch statement 33fb determines whether or not to select a retraction path. The retraction section 33f4 indicates a path along which the nozzle 15 is retracted. The retraction section 33f4 is inserted between the plurality of the cleaning sections 33f3. That is, when the nozzle 15 interferes with the workpiece 17 or the cleaning device 12 in case of directly connecting the cleaning sections 33f3 before and after the retraction section 33f4, the retraction section 33f4 is inserted so that the nozzle 15 does not interfere with the workpiece 17 or the cleaning device 12. The retraction section 33f4 is, for example, a gate motion or a table rotation operation.

When the value 33k of the retraction variable 33hb corresponding to the first retraction section 33f4 is 0, the branch statement 33fb included in the first retraction section 33f4 jumps to one of the closest one of the followings: (1) the next second retraction section 33f4, (2) the next nozzle selection section 33f2, and (3) the footer section 33f5. Otherwise, the first retraction section 33f4 is executed.

FIG. 8 shows an example of the trajectory 42 (gate motion) of the retraction section 33f4 to which the sequence number N650 is assigned. The L-shaped nozzle 153 ejects jet 47 to the cleaning point 33m2 from an opening located on X− side. At this time, the L-shaped nozzle 153 is located on the X− side of the workpiece 17. The trajectory 42 moves the L-shaped nozzle 153 above the workpiece 17, then moves to the X+ side of the workpiece 17 on the XY plane. The L-shaped nozzle 153 moves so as to apply the jet 47 from the X+ side (trajectory 43) when the cleaning section 33f3 subsequent to the current retraction section is read. By moving along the trajectory 42 of the retraction section 33f4, the L-shaped nozzle 153 moves above the workpiece 17 without interfering with the workpiece 17.

As shown in FIG. 6, the footer section 33f5 includes an instruction of the end operation such as origin return operation, door opening, unclamping, or pump stopping.

As shown in FIG. 2, the arithmetic device 32 includes a scanning unit 32a, a numerical control unit 32b, a comparison unit 32c, and a variable setting unit 32d.

The scanning unit 32a controls the scanner 11.

The numerical control unit 32b numerically controls the moving device 14. The numerical control unit 32b controls the pump 18 and the turret 13 in accordance with the cleaning program.

Figure 9:
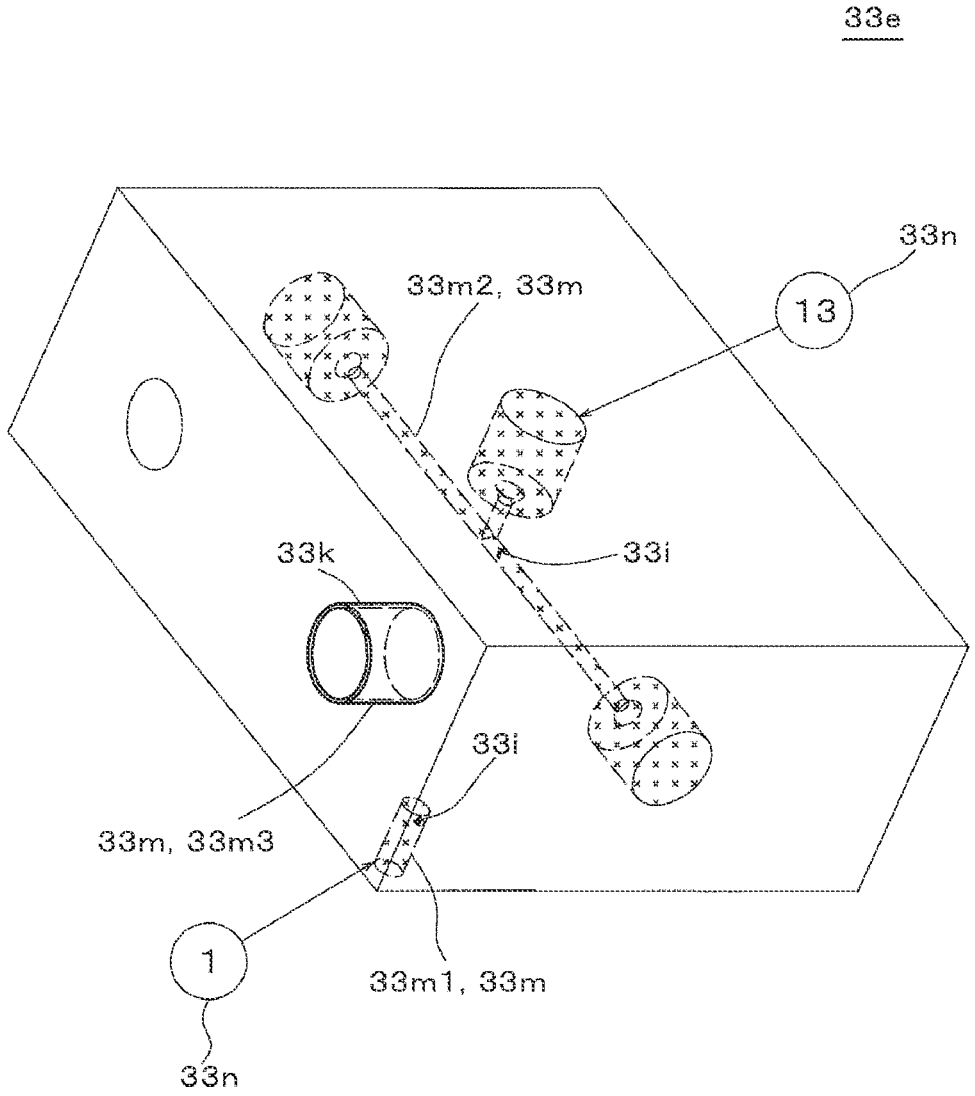
FIG. 9 shows model comparison results according to the embodiment.

As shown in FIG. 9, the comparison unit 32c compares the scan data 33e with the 3D model 33b. The comparison unit 32c identifies the specific structure inside the cleaning point 33m1 and the cleaning point 33m2 as the foreign matter 33i (object to be removed). The comparison unit 32c sets the cleaning point 33m3 as a machining error (excessive diameter) 33k. The comparison unit 32c sends the label 33n affixed to the cleaning points 33m1, 33m2 including the foreign matter 33i to the variable setting unit 32d.

Referring to the left side of FIG. 5, the variable setting unit 32d temporarily assigns 0 to all the variables 33h. Next, the variable 33hc corresponding to the label 33n sent from the comparison unit 32c is read from the label variable reference table 33d. The variable setting unit 32d substitutes 1 for the read cleaning variable 33hc. Next, referring to the right side of FIG. 5, the variable setting unit 32d substitutes 1 for the values 33k of the nozzle variable 33ha and the retraction variable 33hb associated with the cleaning variable 33hc in which the value 33k is 1 (right side of FIG. 5).

Referring to FIG. 2, the input/output port 34 is connected to the moving device 14 and the pump 18.

The input unit 35 is, for example, a keyboard or a pointing device. The input unit 35 may be a software keyboard or a touch panel. The output unit 36 is, for example, a monitor.

The scanner 11, the scanning unit 32a, the comparison unit 32c, the 3D model 33b, and the scan data 33e may be eliminated. At this time, the storage device 33 stores the label 33n of the cleaning point 33m to which the foreign matter 33i adheres. The input/output port 34 stores the label 33n of the cleaning point 33m to which the foreign matter 33i has adhered in the storage device 33.

Figure 10:
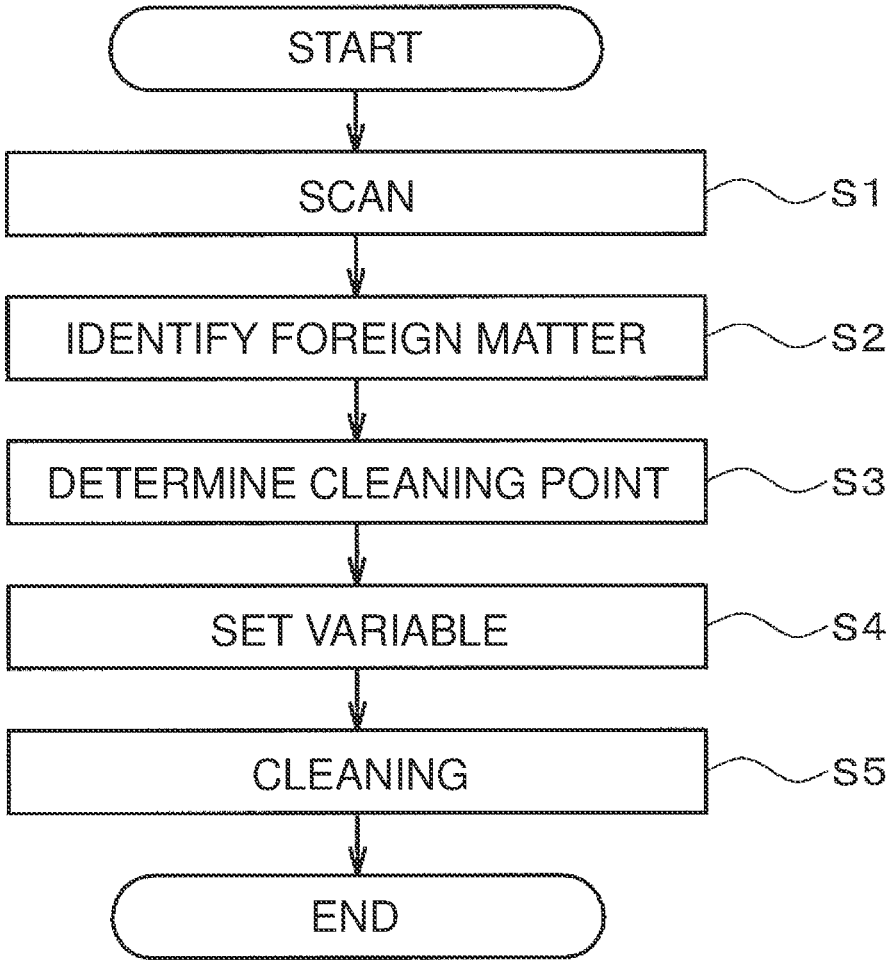
FIG. 10 is a flowchart showing the cleaning method according to the embodiment.
Figure 11:
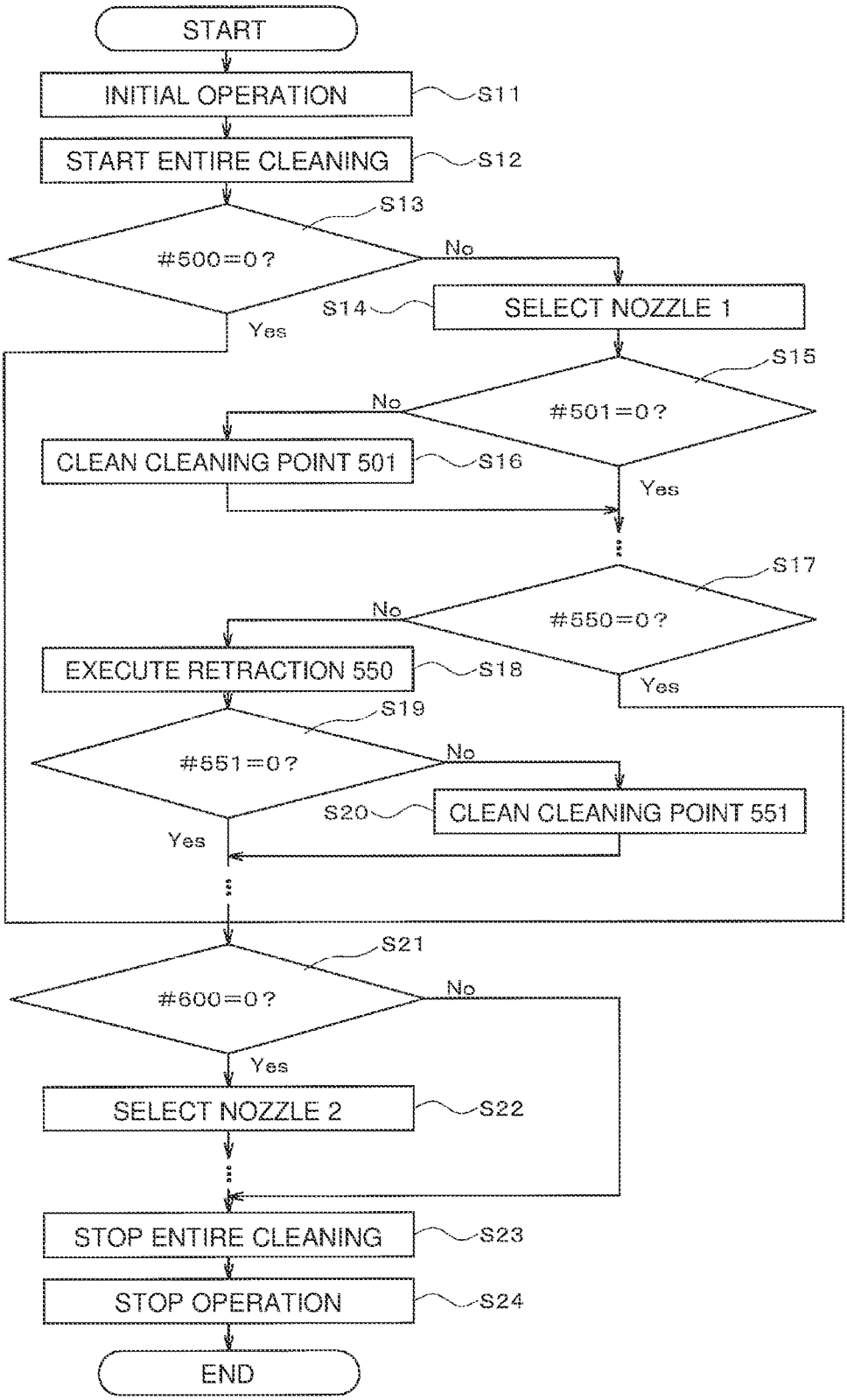
FIG. 11 is a flowchart showing the execution method of the numerical control program according to the embodiment.

The cleaning method will be described with reference to FIG. 10. In step S1, the scanner 11 transmits a particle beam through the workpiece 17 to scan the workpiece 17. The scanning unit 32a stores the scan data 33e including the structure of the workpiece 17 in the storage device 33.

In step S2, the comparison unit 32c compares the scan data 33e with the 3D model to identify the foreign matter 33i. Subsequently, in step S3, the comparison unit 32c identifies the cleaning points 33m1, 33m2 including the identified foreign matter 33i as the cleaning points. The comparison unit 32c stores the label 33n of the identified cleaning points in the storage device 33.

Next, the variable setting unit 32d reads the variable 33h associated with the identified label 33n from the label variable reference table 33*d*. In step S4, the variable setting unit 32*d* assigns 1 to the variable 33*h* associated with the identified label 33*n*, and assigns 0 to the other variable 33*h*.

Finally, in step S5, the cleaning device 12 cleans the workpiece 17 according to the value 33*k* of the variable 33*h* and the numerical control program 33*f*

The steps S1 to S3 may be eliminated. In this case, the label 33*n* of the cleaning point including the foreign matter 33*i* is input to the storage device 33 from the outside through the input/output port 34 or the input unit 35.

The step S5 will be described in detail with reference to FIGS. 1, 2, 5, 6 and 11. First, in step S11, the numerical control unit 32*b* reads the header section 33*f*1 to perform an initial operation. Next, in step S12, the cleaning liquid is jetted from the auxiliary nozzle 23 to start the entire cleaning by showering.

Next, the first nozzle selection section 33*f*2 (sequence number N500) is processed. The numerical control unit 32*b* reads the value 33*k* of the variable 33*ha* whose variable name is #500 from the variable table 33*g*. In step S13, the numerical control unit 32*b* determines whether the read value 33*k* is 0. If the result is YES, in step S21, the process jumps to the next nozzle selection section 33*f*2 (sequence number N600). If the result is NO, the numerical control unit 32*b* sequentially executes the moving command 33*fc* of the first nozzle selection section 33*f*2 (sequence number N500), and the M-code command, and the like. As a result, the nozzle is replaced with the tool number T1, and the cleaning liquid is jetted in step S14.

Next, the numerical control unit 32*b* reads the first cleaning section 33*f*3 (sequence number N501). The numerical control unit 32*b* reads the value 33*k* of the cleaning variable 33*hc* whose variable name is #501 from the variable table 33*g*. In step S15, the numerical control unit 32*b* determines whether the read value 33*k* is 0. If the result is YES, the process jumps to any one of the next cleaning section 33*f*3, the next retraction section 33*f*4, and the next nozzle selection section 33*f*2. If the result is NO, the first cleaning section 33*f*3 (sequence number N501) is sequentially executed. As a result, the nozzle 15 moves and a jet 47 of cleaning liquid collides with the cleaning point 33*m*1 associated with variable #501. Then, in step S16, the cleaning point 33*m*1 is cleaned.

By repeatedly executing the same procedure, the cleaning point 33*m* having the value of the corresponding cleaning variable 33*hc* of 1 is cleaned. The cleaning point 3*m* for which the corresponding cleaning variable 33*hc* is 0 is not cleaned.

The numerical control unit 32*b* reads the first retraction section 33*f*4 (sequence number N550). The numerical control unit 32*b* reads the value 33*k* of the retraction variable 33*hb* whose variable name is #550. In step S17, the numerical control unit 32*b* determines whether the read value 33*k* is 0. If the result is YES, the process jumps to the next second retraction section 33*f*4 or the next nozzle selection section 33*f*2. If the result is NO, the first retraction section (sequence number N550) is sequentially executed in step S18.

The steps S19 and S20 are the same as the steps S15 and S16, respectively.

The steps S21 and S22 are the same as the steps S13 and S14, respectively. The nozzle selected in step S21 is also cleaned in the same procedure as in steps S13 to S20.

The steps S12 and S23 may be eliminated.

In step S23, the numerical control unit 32*b* reads the footer section 33*f*5 to stop the ejection of the auxiliary nozzle 23. Finally, in step S24, an end operation including drying the workpiece 17, unclamping the workpiece 17, shutter opening, and the like is performed.

Figure 12:
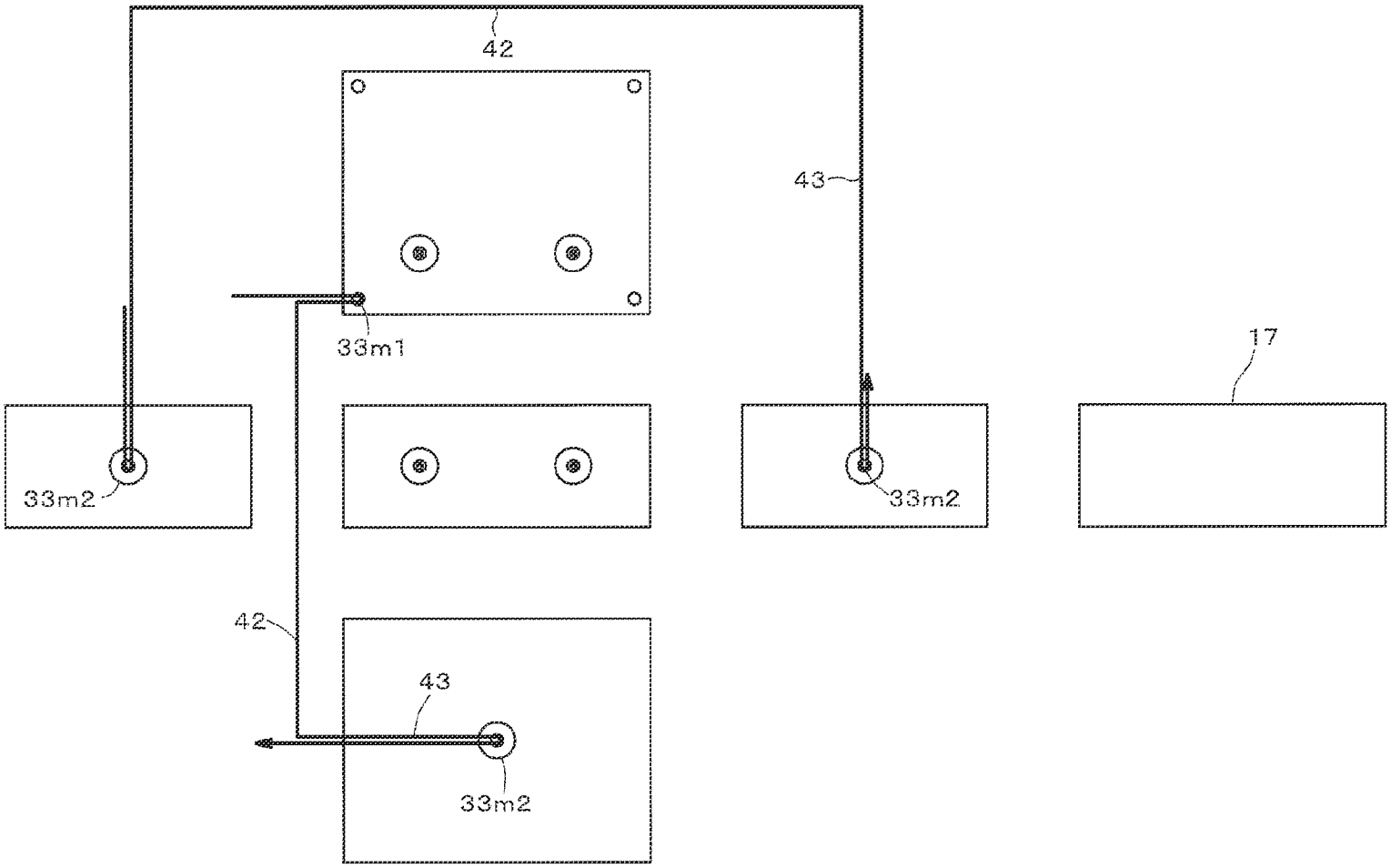
FIG. 12 shows a cleaning path according to the embodiment.

FIG. 12 shows the trajectories 42, 43 of the nozzles 151, 153 on an orthographic view of the workpiece 17 by a third angle projection. The nozzles 151, 153 clean only the cleaning points 33*m*1, 33*m*2.

It should be noted that the present invention is not limited to the embodiments described above, and various modifications can be made without departing from the gist of the present invention, and all technical matters included in the technical idea described in the claims are the subject matter of the present invention. While the foregoing embodiments illustrate preferred examples, those skilled in the art will appreciate that various alternatives, modifications, variations, or improvements may be made in light of the teachings disclosed herein and are within the scope of the appended claims.

REFERENCE SIGNS LIST

10 Cleaning apparatus
11 Scanner
12 Cleaning device
14 Moving device
15, 151, 153 Nozzle (main nozzle)
17 Workpiece
31 Control device (Numerical control device)
33*b* 3D model
33*f* Numerical control program
33*f*3 Cleaning section
33*fb* Branch statement
33*hc* Cleaning variable
33*i* Foreign matter (to be removed)
33*k* Value
33*m* Cleaning point
47 Jet (cleaning liquid jet)

What is claimed is:

1. A cleaning method for a workpiece with foreign matter adhered, the cleaning method comprising:

transmitting a particle beam to the workpiece with foreign matter adhered to scan a three-dimensional structure of the workpiece;

comparing the three-dimensional structure of the workpiece and the foreign matter obtained by the scanning with a 3D model of the workpiece;

identifying cleaning points of the workpiece with the foreign matter adhered based on a result of the comparison;

substituting a true value to a cleaning variable for the identified cleaning points;

generating a cleaning liquid jet from a main nozzle; and causing a numerical control program including a plurality of cleaning sections and a retraction section inserted between the plurality of cleaning sections to skip a first cleaning section and jump to a next second cleaning section if the cleaning variable has a false value, execute the first cleaning section to direct the main nozzle toward the cleaning points if the cleaning variable has a true value, skip a first retraction section and jump to a next second retraction section if all the cleaning variables of the cleaning points between the first retraction section and the second retraction section have false values, and execute otherwise the first retraction section.

2. The cleaning method according to claim 1, further comprising:

causing the numerical control program to execute the first retraction section while moving the main nozzle such that the main nozzle does not interfere with the workpiece or a cleaning device.

3. The cleaning method according to claim 1, further comprising:

causing the numerical control program to jump to a next second nozzle selection section if all the cleaning variables of the cleaning points associated with a first nozzle selection section have false values, and execute otherwise, the first nozzle selection section to change the main nozzle.

4. The cleaning method according to claim 1, further comprising:

causing the numerical control program to set a nozzle variable to a false value if all the cleaning variables of the cleaning points associated with a first nozzle selection section have false values, jump to a next second nozzle selection section if the nozzle variable has a false value, and execute the first nozzle selection section if the nozzle variable has a true value.

5. The cleaning method according to claim 1, further comprising:

jetting cleaning liquid from an auxiliary nozzle toward the workpiece to clean entire surface of the workpiece while the main nozzle is cleaning.

* * * * *